United States Patent [19]

Wolff et al.

[11] Patent Number: 4,671,195

[45] Date of Patent: Jun. 9, 1987

[54] SEWING MACHINE LOOPER THROW-OUT MECHANISM

[75] Inventors: James W. Wolff, Chicago; James C. Hsiao, Morton Grove, both of Ill.

[73] Assignee: Union Special Corporation, Chicago, Ill.

[21] Appl. No.: 891,444

[22] Filed: Jul. 29, 1986

Related U.S. Application Data

[63] Continuation of Ser. No. 700,224, Feb. 11, 1985, abandoned.

[51] Int. Cl.[4] ..... D05B 1/10; D05B 57/32

[52] U.S. Cl. ..... 112/199; 112/166

[58] Field of Search ..... 112/166, 167, 197, 199, 112/200

[56] References Cited

U.S. PATENT DOCUMENTS

| | | | |
|---|---|---|---|
| 1,252,696 | 1/1918 | Hugg | 112/197 |
| 1,912,959 | 6/1933 | Zeier et al. | 112/199 |
| 2,172,321 | 9/1939 | Kucera | 112/200 |
| 2,946,301 | 7/1960 | Hacklander | 112/200 |
| 3,141,427 | 7/1964 | Gross | 112/200 |

*Primary Examiner*—Wm. Carter Reynolds

*Attorney, Agent, or Firm*—Powell L. Sprunger

[57] ABSTRACT

A looper throw out mechanism is provided for bodily moving sewing machine loopers from their normal operative position to a servicable position and back. The looper throw out mechanism includes a looper carrier pivotally arranged on the looper drive shaft, a fork like member attached to the looper carrier, a control disc disposed in operative combination with the fork like member for defining the angular displacement limits of the looper carrier, and a manually operated locking device for releasably securing the looper carrier to the looper drive shaft. When looper servicing is desired, the locking device is released by the operator permitting the looper carrier and the loopers to be pivoted to a serviceable position removed from their operative position.

9 Claims, 6 Drawing Figures

SEWING MACHINE LOOPER THROW-OUT MECHANISM

This is a continuation of application Ser. No. 700,224, filed Feb. 11, 1985 abandoned.

FIELD OF THE INVENTION

This invention relates to chainstitch sewing machines having one or more loopers and, more particularly, to a mechanism capable of selectively moving the loopers beyond their normal operative range of movement to be readily available for servicing.

BACKGROUND OF THE INVENTION

In the majority of chainstitch sewing machines, one or more thread carrying loopers are employed to interloop their thread with the needle thread loop formed beneath the fabric. This action allows the thread to be concatenated into a stitch in the workpiece. In such machines, the looper is usually disposed in an area complicated by other mechanisms; i.e., feed mechanisms, throat plate, thread cutters, loop retainers, and etc. Therefore, operator access to the looper for purposes of servicing is extremely limited.

Mechanisms for retracting the looper to a threading position by bodily moving the looper are known in the art. Examples of this construction are illustrated in U.S. Pat. Nos. 1,912,959; 2,029,233; and, 3,354,851. With the ever increasing speeds of today's machines, however, it is been found necessary to compliment these mechanisms with additional features to prevent undesirable movement of the looper from its operative position while the machine is operating.

SUMMARY OF THE INVENTION

The present invention provides an improvement over the heretofore known looper throw out mechanisms by providing an improved arrangement for bodily moving the loopers to a servicable position and for locking the loopers in their operative position. To this end, the present invention includes a machine having a looper drive shaft and an operator influenced control assembly operatively secured to the shaft and effective to rotatably shift the looper means between operative and nonoperative positions. The assembly of the present invention includes looper carrier means arranged for pivotal movement on said shaft, a control disc adjustably fixed on said shaft and arranged in operative combination with a fork like member supported by the looper carrier means. The operative association of the control disc and the fork like member serves to prevent displacement of the looper carrier along the axis of the shaft. The control disc is provided with seperate locating surfaces defining operative and nonoperative positions of the looper means. The tines of the fork like member are adapted for alternative positive engagement against either of the locating surfaces for positioning the looper carrier and thereby the loopers. Operator controlled means are provided for selectively restraining the pivotal displacement of the carrier means relative to the shaft. Means are further provided for urging the looper means into their operative position.

In line with all of the above, it is a primary object of this invention to provide an improved looper throw out mechanism for chainstitch sewing machines.

Another object of this invention is the provision of suitable means which will facilitate the servicing of sewing machine loopers and reduce the time required for this operation.

Another object of this invention is to provide a looper throw out mechanism which may be simply operated at one end of the looper actuating shaft.

A further object of this invention is the provision of a looper throw out means which includes means for biasing the loopers into their normal operating position.

BRIEF DESCRIPTION OF THE DRAWINGS

Having in mind the above obJects and other attendent advantages that will be evident from an understanding of this disclosure, the invention comprises the devices combinations, and arrangement of parts as illustrated in the presently preferred embodiment of the invention which is hereinafter set forth in detail to enable those skilled in the art to readily understand the functions, operation, construction and advantages of it when read in conjunction with the accompanying drawings in which.

DETAILED DESCRIPTION OF THE PREFERRED EMBODIMENT

Figure 1:
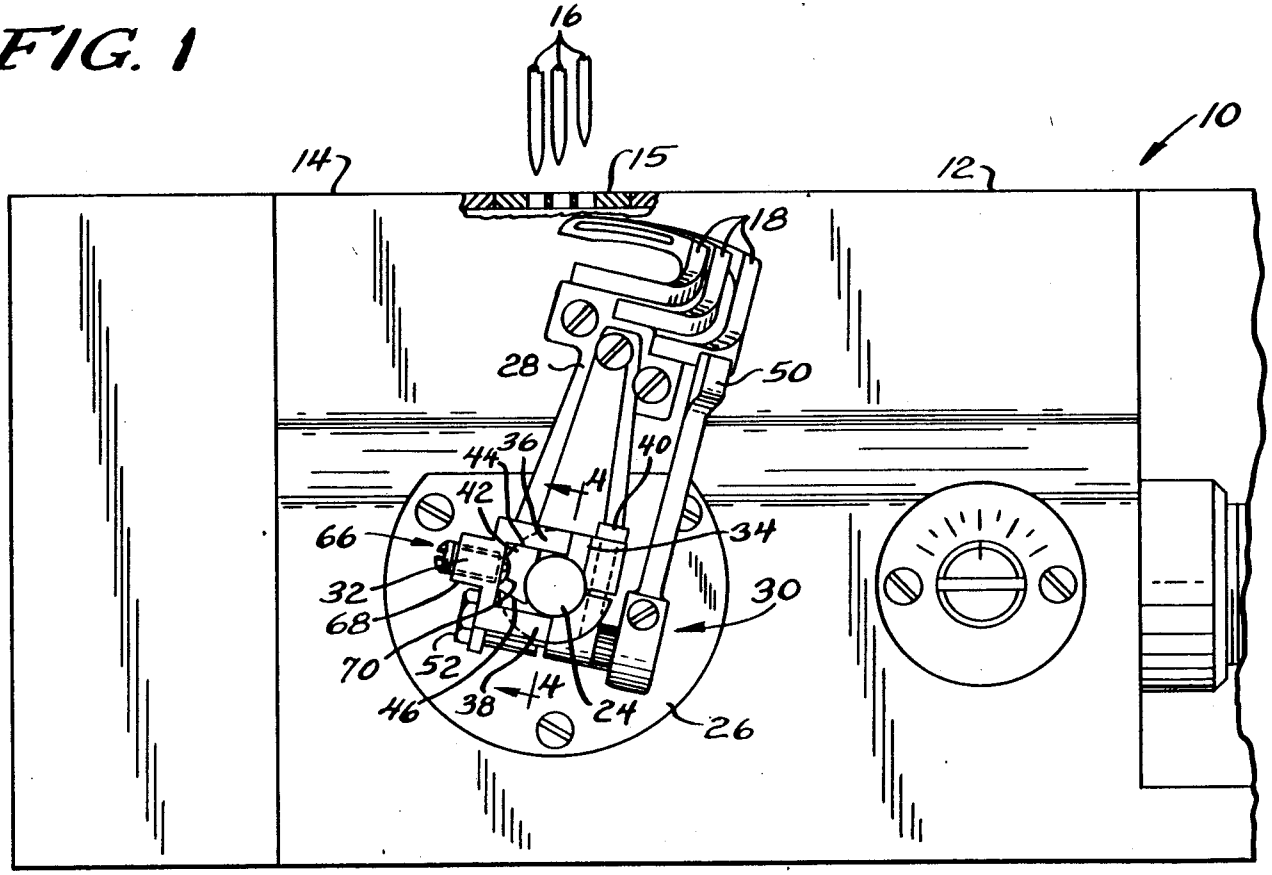
FIG. 1 is a schematic front view of a portion of a chainstitch sewing machine embodying the present invention.
Figure 2:
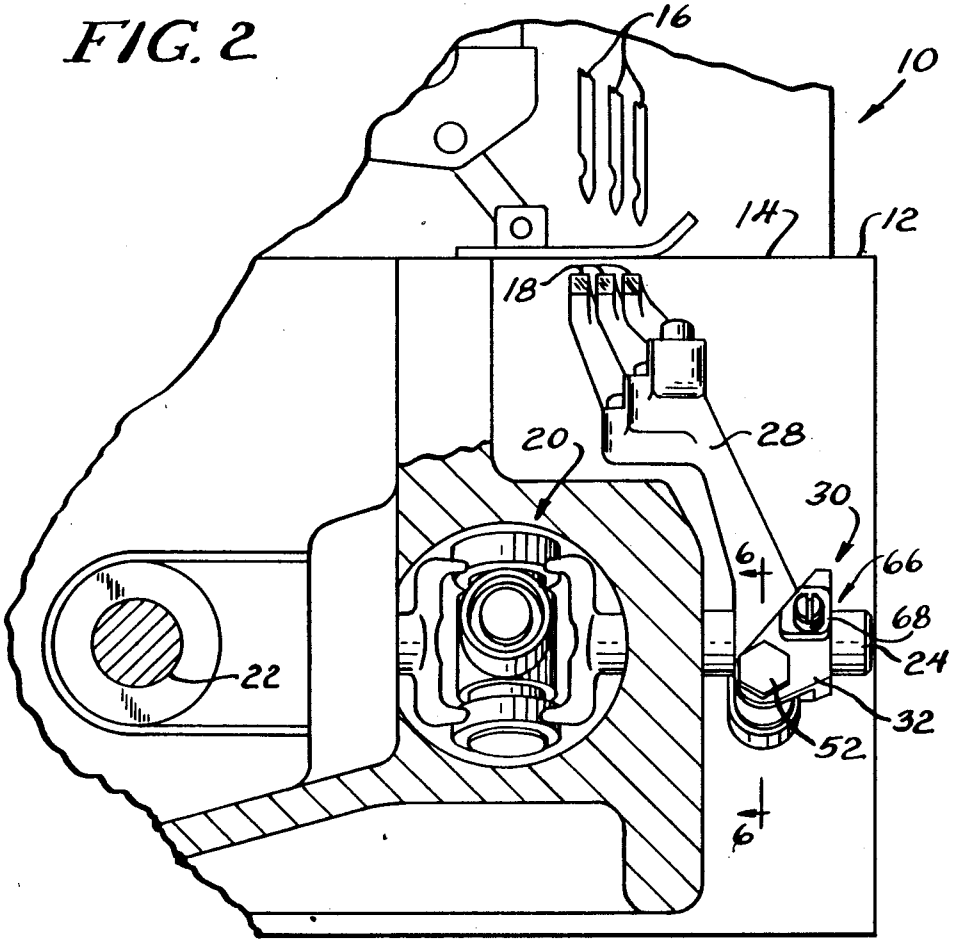
FIG. 2 is a side fragmentary view of the sewing machine shown in FIG. 1.

Referring now to the drawings, wherein like reference numerals indicate like parts throughout the several views, in FIGS. 1 and 2 there is schematically illustrated a portion of a chainstitch sewing machine 10. The machine 10 includes a frame having a base portion or bed 12 provided with a work supporting surface 14 which may include the work supporting surface of a throat plate 15. The machine also includes one or more endwise reciprocatory needle means 16. Arranged in the bed beneath the sewing needles are an equal number of thread carrying looper means 18 which are adapted for cooperation with the needle means to conventionally form chainstitches in a workpiece being advanced through the sewing station of the machine. In the particular embodiment shown, the loopers are driven along an elliptical like path such that they simultaneously partake of oscillatory and rocking motions. That is, the looper motion includes movement endwise across the path of the needle's reciprocation to seize and shed needle thread loops and also an alternating sideways motion to avoid the needle means alternatively on opposite sides thereof. The four motion path which the loopers execute is well known in the sewing machine industry for sewing chainstitches (Federal Stitch Type 401).

In order to drive the loopers in the required elliptical motion and in timed relation to the reciprocation of the needles, a looper drive mechanism 20 is provided. As may be best described in connection with FIG. 2, the looper drive mechanism is operatively connected to a driven shaft 22 arranged in the machine bed 12. The looper actuating or drive mechanism may be similar to the type disclosed in U.S. Pat. No. 2,998,787 granted Sept. 5, 1981 to K. Pollmeier, the full disclosure of which is incorporated herein by reference. Suffice it to say, an output shaft 24 of the looper drive mechanism projects beyond the machine bed. The shaft may be journaled for oscillation and rotation along and about its longitudinal axis in a bore of a bushing 26 (FIG. 1) secured in the frame of the machine. Releasably clamped on the shaft 24 is a looper holder or carrier 28 which extends upwardly and carries at its upper end the loopers 18. Thus, the loopers partake of the motion of the shaft 24.

Figure 3:
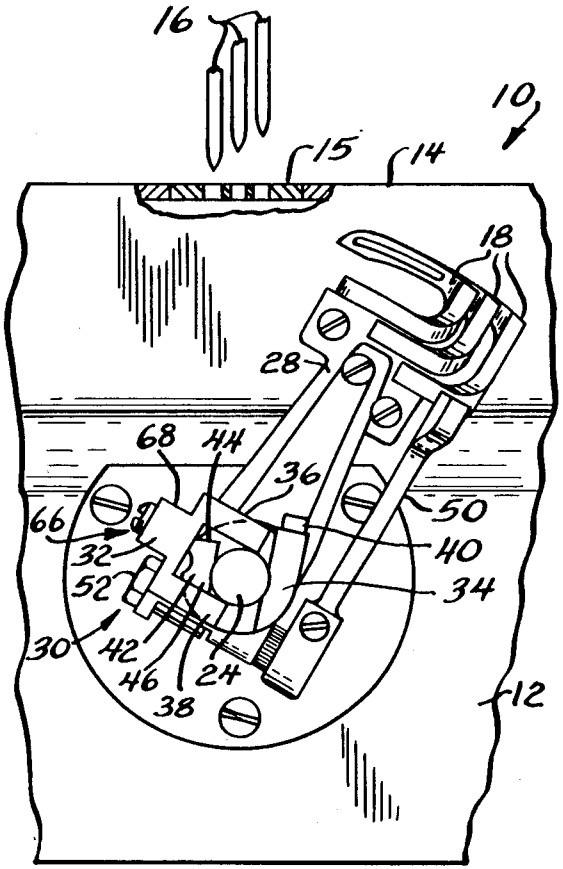
FIG. 3 is a fragmentary front view illustrating the present invention with the sewing machine loopers disposed in their nonoperative position.

Thus far, what has been described is conventional. Because of the limited room beneath the work supporting surface of the machine, when it is desired or necessary to service the loopers, it is desirous to bodily move same beyond their normal operating position illustrated in FIG. 1 to a more convenient position as illustrated in FIG. 3. To this end, the present invention is provided.

Figure 4:
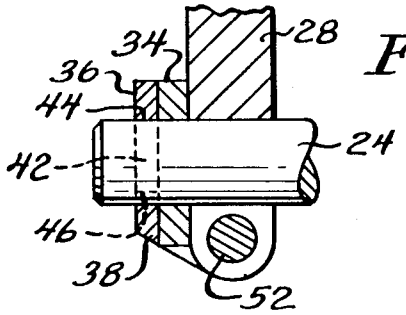
FIG. 4 is a sectional view taken along line 4—4 of FIG. 1.
Figure 6:
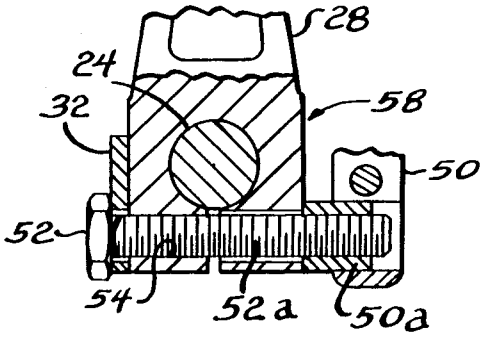
FIG. 6 is an enlarged sectional view taken along 6—6 of FIG. 2.
Figure 5:
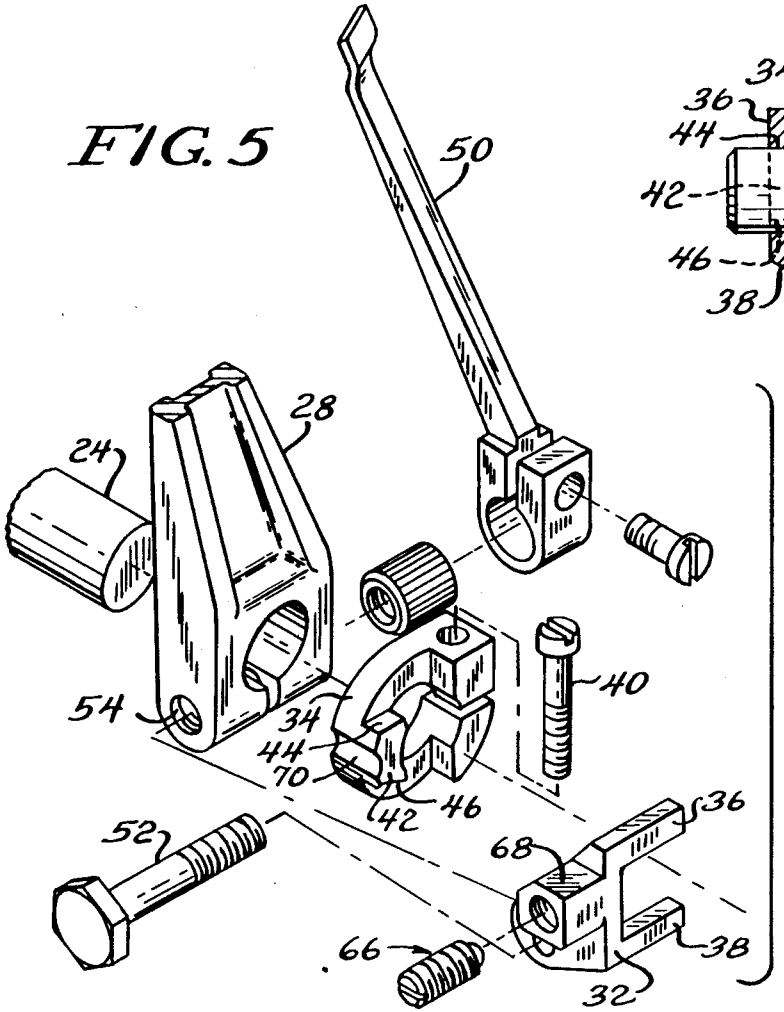
FIG. 5 is a perspective view of the looper throw out mechanism of the present invention.

In order to conveniently accomplish the above result, the present invention provides a looper throw out mechanism generally designated by reference numeral 30. The looper throw out mechanism of the present invention provides an operator controlled releasable connection between the loopers and their operating shaft. As best seen in FIGS. 1 and 5, the looper throw out mechanism includes a fork like member 32 and a control member or disc 34. The forked member 32 is secured by screw means 52 to and therefore rockable with the looper carrier means 28. The member 32 is provided with two spaced apart tines or arms 36 and 38 distantly arranged from the looper carrier and which are disposed on opposite sides of the rock shaft 24. Turning to FIG. 4, accomodated in the space between the arms 36 and 38 of member 32 and the looper carrier 28 is the control member or disc 34. Returning to FIGS. 1 and 5, the disc 34 is fixedly secured to the rock shaft 24 by means of a fastener 40 and cooperates with the member 32 in a manner whereby securing the looper carrier from lateral displacement along the longitudinal axis of the shaft 24. From one face of the plate like member 34 protrudes a block 42. As seen in the drawings, the spaced apart legs 36 and 38 of the fork like member 32 straddle the aforesaid block 42. The upper and lower surfaces 44 and 46, respectively, of the block 42 limit the angular or pivotal displacement of the looper carrier 28 with respect to the control disc 34. This end is accomplished by providing an alternative abutting relationship between the arms 36 and 38 of member 32 and the locating surfaces 44 and 46 of the control disc 34. That is, in one position, the looper means may be located in their operative position by positioning or locating the arm 36 of the fork like member 32 against the locating surface 44 of the control disc 34. When desired, the loopers may be moved to their nonoperative position, which is beyond the range of normal rocking movement, by rotating the looper carrier until the arm 38 of member 32 abuts against the other locating surface 46 of the control disc 34. In order to secure the looper carrier 28 in either of its adjustable positions, the looper throw out device includes a manually operable lever 50. As mentioned above, the looper carrier means 28 is pivotally carried on the rock shaft 24. As best seen in FIGS. 1, 3 and 6, at its lower most end, the looper carrier 28 is provided with a releasable split strap connection. The operative connection of the looper carrier to the shaft is accomplished by means of the bolt or fastener 52 which extends through a bore 54 (FIG. 6) provided in the carrier 28. The manually operable lever 50 is threadably engaged with one end of the bolt 52 to effect a clamping action thus positively securing the looper carrier to the shaft 24. To release the looper carrier 28 so that the loopers may be thrown or moved to a serviceable position, as illustrated in FIG. 3, the lever 50 is appropriately moved to unscrew internally threaded member **50*a* from bolt 52 to release the clamping relationship of the carrier 28 to the shaft 24 specifically as shown in FIG. 6, lever 50 is clamped to internally threaded member 50*a* which in turn cooperates with the external threads 52*a* of bolt 52 to exert a compressive action on carrier 28**.

In the preferred embodiment, the looper carrier means 28 and thereby the looper means 18 are biased into their operative position by means of a spring biased detent assembly 66. The detent assembly is threadably arranged in a projection 68 provided on the member 32. The operative end of the detent assembly engages an appropriately inclined or concave surface 70 provided on the periphery of the control disc 34. The operative end of the detent assembly 66 engages the control disc 34 in a manner such that the arm 36 of the member 32 is continually urged against the locating surface 44 of the control disc 34 whereby locating the loopers in their operative position.

An exemplary operative procedure according to the invention will now be described. When it is necessary to service the loopers, the manually operable lever 50 is swung downward thus releasing the clamping relationship of the looper carrier means 28 with the rock shaft 24. The carrier may then be rotated in a clockwise direction (FIG. 1) such that the detent assembly 66 rides out of the concavity 70 to remove the loopers to their nonoperative position shown in FIG. 3. The extent of angular displacement of the looper carrier 28 being limited by the control disc 34. That is, the looper carrier 28 may be rotated clockwise (FIG. 1) until the arm 38 of the fork like member 32 abuts the locating surface 46 of the control disc 34. Because the control disc may be adjustably secured to the shaft, the disposition of the locating surfaces 44 and 46 and thus the operative and nonoperative positions of the loopers may be modulated as required. After the loopers have been serviced, the looper carrier is rotated in a counterclockwise direction (FIG. 1) whereby returning the loopers to their operative position. The counterclockwise rotation of the looper carrier continues until the arm 36 of the fork like member 32 again abuts the locating surface 44 of the control disc 34 thereby preventing further rotation of the looper carrier and thus positioning the loopers in their operative position. The spring detent assembly 66 action against the inclined peripheral surface 70 of the control disc 34 serves to maintain the loopers in their operative position while the manually operable means 50 is moved to clamp the looper carrier 28 to the shaft whereby setting the machine for continued operation. From the above, it will be apparent that a very simple means has been provided whereby the loopers are firmly held secured to the drive shaft by an operator manipulated device which quickly and easily releases the looper from the operative connection with the shaft and allows same to be moved to a nonoperative position.

Thus there has been provided a Sewing Machine Looper Throw Out Mechanism which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described our invention, what we claim is:

1. In a chainstitch sewing machine including reciprocatory needle means for cooperating with a looper, means for actuating said looper in an elliptical operating path in timed relation with the needle means, said looper actuating means including a shaft supported in the machine for pivotal and axial movement along and about its longitudinal axis, the improvement comprising looper throw out means for selectively moving said looper to a retracted position and for locking said looper in an operative position, said looper throw out means comprising:

looper carrier means arranged on said shaft for pivotal movement relative thereto;

operative means for limiting the pivotal displacement of said looper carrier means between positions defining retracted and operative positions for said looper means, said operative means including a member secured to said looper carrier means and having two spaced arms, a control disc with two stopping surfaces disposed between the spaced arms of said member for defining the angular displacement limits of said looper carrier means; and means for selectively restraining pivotal movement of said carrier means relative to said shaft.

2. The looper throw out means of claim 1 wherein said control disc includes means for adjustably securing the disc to the shaft in a manner whereby the disposition of the stopping surfaces and thereby the operative and retracted positions of said looper means may be modulated.

3. The looper throw out means of claim 1 wherein the disposition of said control disc further prevents lateral displacement of said looper carrier means along the longitudinal axis of said shaft.

4. The looper throw out means of claim 1 wherein said control disc is disposed between the looper carrier means and the arms of said member.

5. A sewing machine including a frame, a looper, a looper shaft rotatably and translatably journaled in said frame for moving said looper in an elliptical like path, and a looper throw out mechanism comprising:

a looper carrier means pivotally arranged on said shaft;

fork like member means carried for movement with said carrier means;

manually operated means for releasably securing said looper carrier to said shaft; and a plate like member fixedly arranged on said shaft in operative combination with the fork like member for limiting the pivotal displacement of said looper carrier means between operative and nonoperative positions.

6. The invention according to claim 5 further including means carried by said fork like member for urging said carrier means into its operative position.

7. In a sewing machine having a frame, a thread carrying looper means, shaft means supported in and extending beyond said frame for imparting elliptical like movements to said looper means, and means for selectively moving said looper means beyond the normal range of movement thereof to a position convenient for threading, comprising:

an operator influenced control assembly operatively connected to said shaft and effective to shift said looper means between operative and nonoperative positions, said assembly including looper carrier means pivotally arranged on said shaft, operator controlled means for selectively securing the looper carrier means against pivotal movement relative to the shaft, control means carried by said shaft and including seperate locating surfaces defining the operative and nonoperative positions of said looper means, and looper locating means supported on said carrier means and arranged for positive engagment against either of said locating surfaces for determining the disposition of said looper means.

8. The invention according to claim 7 further including means for urging said locating means against one of the locating surfaces provided on said control means.

9. The invention according to claim 7 wherein said control means and said looper locating means combine to prevent lateral displacement of said looper carrier means along said shaft means.

* * * * *